US006484462B2

(12) United States Patent
Shreiner et al.

(10) Patent No.: US 6,484,462 B2
(45) Date of Patent: Nov. 26, 2002

(54) SEISMIC EXPANSION JOINT COVER

(75) Inventors: Thomas A. Shreiner, Picture Rocks, PA (US); Roger W. Barr, Williamsport, PA (US)

(73) Assignee: Construction Specialties, Inc., Lebanon, NJ (US)

( * ) Notice: Subject to any disclaimer, the term of this patent is extended or adjusted under 35 U.S.C. 154(b) by 133 days.

(21) Appl. No.: 09/781,495

(22) Filed: Feb. 12, 2001

(65) Prior Publication Data

US 2002/0108322 A1 Aug. 15, 2002

(51) Int. Cl.[7] ..... E04F 15/14

(52) U.S. Cl. ..... 52/393; 52/394; 52/395; 52/396.02; 52/396.03; 52/396.04; 52/396.05; 52/396.06; 52/573.1; 52/459; 52/468; 404/68

(58) Field of Search ..... 52/393, 573.1, 52/396.02, 396.03, 395, 396.06, 396.09, 394, 396.04, 396.05, 461, 463, DIG. 4, 468, 471, 466, 459; 404/68

(56) References Cited

U.S. PATENT DOCUMENTS 3,609,934 A * 10/1971 O'Carroll ..... 52/483
3,629,756 A * 12/1971 Holtz ..... 335/285
5,048,249 A * 9/1991 Shreiner et al. ..... 52/403
5,078,529 A 1/1992 Moulton
5,357,727 A * 10/1994 Duckworth et al. ..... 52/396.03
5,476,559 A * 12/1995 Chiro ..... 156/71
5,611,181 A * 3/1997 Shreiner et al. ..... 52/396.04
5,644,879 A 7/1997 Shreiner et al.
5,666,775 A * 9/1997 Shreiner et al. ..... 52/396.04
5,829,216 A * 11/1998 Newcomb et al. ..... 52/395
5,832,678 A 11/1998 Newcomb et al.
5,887,400 A * 3/1999 Bratek et al. ..... 52/396.03
6,235,378 B1 * 5/2001 Lowder ..... 428/215
6,430,884 B1 * 8/2002 Shreiner et al. ..... 52/393

* cited by examiner

*Primary Examiner*—Jose V. Chen
*Assistant Examiner*—Dennis L. Dorsey
(74) *Attorney, Agent, or Firm*—Baker Botts L.L.P.

(57) ABSTRACT

A seismic expansion joint cover includes a bridge panel having one end supported for movement in the y-axis direction and against movement in the x-axis direction relative to a floor A on one side of a motion-absorbing gap and supported at the other end for movement in the x-axis direction and against movement in the y-axis direction relative to a floor B. A recess in floor B receives a portion of the bridge panel in all positions of the bridge panel relative to floor B. A recess cover plate covers the recess, is supported at one end in sliding relation on the bridge panel in all positions of the bridge panel relative to floor B and is joined at the other end to an end member of the recess frame remote from the gap. A resiliently collapsible/extensible honeycomb panel received in the recess in floor B supports the portion of the recess cover plate that spans the recess between the end of the bridge panel and the end member of the recess frame. The recess cover plate is held down on the bridge panel by magnetic strips.

23 Claims, 9 Drawing Sheets

SEISMIC EXPANSION JOINT COVER

BACKGROUND OF THE INVENTION

Seismic expansion joint covers for buildings in geographic regions that are prone to earthquakes are of special designs that allow for movements of the building elements on either side of the expansion gap that are very much greater than the movements that occur as a result of thermal expansion and contraction. In that regard, buildings currently being built in earthquake-prone regions are usually supported on isolators that attenuate the intensities of shocks imparted to the building structure but increase the durations and magnitudes of the swaying motions of the structure as it displaces and deforms when forces due to the earthquake are imposed on its foundation supports. When a building is composed of two or more adjacent independent structural units, each structural unit is subject to movements in an earthquake that are different in direction, frequency and magnitude. This is the case, indeed, regardless of whether the units are mounted on isolators or not. Adjacent structural units of a building are, accordingly, subject to large relative movements having components toward and away from each other (perpendicular to the gap)—x-axis movements—and components parallel to the gap—y-axis movements. Because the connections between structural units at expansion joints (which might better be termed "motion-absorbing gaps") occur at the perimeters of the structural units, the movements include small but meaningful relative displacements vertically and angularly between floor portions on opposite sides of gaps due to the rocking of the floors at the perimeter of the structural unit about a fulcrum in the region of the bottom center of the structural unit.

U.S. Pat. No. 5,644,879 (Shreiner et al. Jul. 8, 1997), which is owned by the assignee of the present invention and is hereby incorporated herein by reference for all purposes, describes and shows a seismic expansion joint cover assembly that is adapted to span a gap between the floors of building sections on opposite sides of a motion-absorbing gap and that permits relative movements of the floors substantially horizontally toward and away from each other along an axis perpendicular to the gap ("x-axis direction") and substantially horizontally relative to each other along an axis parallel to the gap ("y-axis direction"). The assembly includes a rectangular structural floor bridge panel that spans the gap in all relative positions of the floors. One end of the bridge panel is attached to the floor on one side of the gap ("floor A") for movement in the y-axis direction and against movement in the x-axis direction relative to floor A. The other end of the bridge panel is supported on the floor of the other building section ("floor B") for movement in the x-axis direction and against movement in the y-axis direction relative to floor B.

In order for the upper surface of the seismic expansion joint cover to be substantially flush with the upper surfaces of floors A and B, floor B has a rectangular recess having a width in the y-axis direction substantially equal—with some clearance—to the y-axis width of the bridge panel and a length in the x-axis direction sufficient to permit excursions of floor A relative to floor B in the x-axis direction in an earthquake so that floor B supports the bridge panel in all positions of floors A and B relative to each other. In the normal—no earthquake—relative positions of floors A and B, the bridge panel occupies roughly half of the recess in floor B. When floors A and B are farthest apart in an earthquake, the bridge panel must occupy a small part of the recess, inasmuch as its floor B end must remain supported on floor B, but most of the recess is empty. When floors A and B are closest together in an earthquake, the bridge panel occupies most of the recess. Hence, a cover over the recess and the bridge panel provides a flush upper surface of the seismic expansion joint cover for supporting persons and other loads that move over the expansion gap in both a normal (no earthquake) condition and during an earthquake.

In particular, a cover plate frame is installed along the side and end edges of the recess and has side members closely adjacent the sides of the bridge panel and an end member spaced apart from the floor B end of the bridge panel far enough to permit the bridge panel to move toward the end of the recess of floor B relative to the floor bridge panel in the x-axis direction when the gap narrows. A first cover plate ("panel cover plate") is supported by a portion of the bridge panel proximate to floor A. A second cover plate ("recess cover plate") is supported by the cover plate frame and by a portion of the bridge panel adjacent the floor B end. The panel cover plate and the recess cover plate have surfaces flush with each other and adjacent end edges slightly spaced apart from each other to permit normal movements of floors A and B due to thermal expansions and contractions of the building structures. The recess cover plate is resiliently attached to the cover plate frame such as to keep it in place horizontally while permitting it to lift from supported relation on the bridge panel and ride up onto and over a portion of the panel cover plate when the motion-absorbing gap narrows in an earthquake.

In its broadest aspects, the seismic expansion joint cover of the '879 patent (referred to above) has a structural floor bridge panel that spans the motion-absorbing gap in all positions of floors A and B, a covered cavity that accepts the floor B end of the bridge panel in all positions of floors A and B, and two flush cover plates that provide a surface over which persons and objects move across the assembly. The recess cover plate is attached resiliently to the cover plate frame of the recess so that the recess cover plate can lift up and slide over the panel cover plate when the gap narrows In order to avoid having to make the recess cover plate unduly thick and heavy, the '879 patent proposes to provide one or more movable transverse beams to support the recess cover plate between the floor B end of the bridge panel and the end member of the cover plate frame. Each transverse beam extends between and is slidably supported by the side members of the cover plate frame. Control arms move the transverse beam toward and away from the end member of the cover frame upon and in a proportional relationship of one-half to movements of floor B relative to the bridge panel.

Despite having many advantages, some parts and assemblies of the seismic expansion joint cover of the '879 patent are of relatively complicated and costly construction and somewhat time-consuming to install. One of the systems of the '879 patent seismic expansion joint cover that has shortcomings of the foregoing nature is the moving beam assembly for supporting loads on the recess cover plate. The beams, linkages, and slide elements are expensive to make and install and add weight and complexity to the system. The weight produces relatively large inertial forces, which act not only on the components of the moving beam assembly but on the recess frame, the bridge panel, and the y-axis and x-axis supports for the bridge panel. Another undesirably complex arrangement is the resilient mounting of the recess cover plate on the recess frame (see FIG. 10 of the '879 patent).

SUMMARY OF THE INVENTION

One object of the present invention is to provide a seismic expansion joint cover assembly for floors that is able to sustain a severe earthquake with little likelihood of damage to the components of the assembly or to the floor portions in which it is installed. Another object is to provide an expansion joint cover assembly that can be quickly and easily restored to its normal operating configuration after it has been disturbed by an earthquake. Still another object is to provide an expansion joint cover that has a flush, essentially smooth upper surface. It is also an object to provide a seismic expansion joint cover that can be fabricated in units that are easy to transport to a job site and to handle and install at the job site and to simplify some of the components and arrangements of the seismic expansion joint cover of the '879 patent.

The foregoing objects are attained, in accordance with the present invention, by a seismic expansion joint cover assembly that is adapted to span a motion-absorbing gap between a floor A on one side of the gap and a floor B on the other side of the gap and that permits relative movements of floors A and B substantially horizontally toward and away from each other along an x-axis perpendicular to the gap and relative movements of floors A and B substantially horizontally relative to each other along a y-axis parallel to the gap. The seismic expansion joint cover includes a bridge panel, a retainer adapted to be affixed to floor A and supporting a first end of the bridge panel for movement in the y-axis direction and against movement in the x-axis direction relative to floor A, and a recess frame adapted to be affixed in a recess in floor B receiving a portion of the bridge panel in all positions of the bridge panel relative to floor B. A recess cover plate covers the recess, a portion of the recess cover plate adjacent the end nearer to the gap being supported in sliding relation on the bridge panel in all positions of the bridge panel relative to floor B and the end farther from the gap being joined to an end member of the recess frame remote from the gap. A collapsible/extensible honeycomb panel adapted to be received in the recess in floor B supports the portion of the recess cover plate that spans the recess between the second end of the bridge panel and the end member of the recess frame.

The honeycomb panel greatly simplifies the seismic expansion joint cover by eliminating the complicated moving beam and the associated linkages and slides of the seismic expansion joint cover of the '879 patent. The honeycomb panel is 1) light in weight, thus reducing inertial forces throughout the moving structures and also making it easy to handle and install; 2) inexpensive and durable; and 3) provides excellent and structurally favorable support for the recess cover plate, in that it supports the recess cover plate uniformly over its area of engagement with the recess cover plate, rather than along a transverse band, thus making it possible to use a thinner plate.

In preferred embodiments, one end of the honeycomb panel is coupled to the bridge panel and the other end is secured against horizontal movements relative to the end member of the recess frame. The honeycomb panel may be coupled to the bridge panel by a first coupling member having many spaced-apart upstanding pins, each pin being received in a cell of the honeycomb panel. The other end of the honeycomb panel may be likewise secured against movement relative to the end member of the recess frame by a second coupling member having many spaced-apart upstanding pins, each pin being received in a cell of the honeycomb panel. The anchor pin members are simple and inexpensive, very easy to install, and considerably facilitate installation of the honeycomb panel.

It is desirable to have the underside of the honeycomb panel supported in sliding relation on a sheet of low-friction polymeric material installed on the floor of the recess of floor B. A suitable honeycomb panel is a honeycomb made of paperboard impregnated with a polymeric material. Honeycomb panels of other materials, such as aluminum and stainless steel can also be used.

Another aspect of the present invention relates to the way in which the recess cover panel is installed so that it normally is held down in supported relation on the bridge panel but is able to lift up and slide over a bridge panel cover plate when the energy-absorbing gap closes in an earthquake. In particular, the bridge panel has an upper surface formed by a sheet of a metal that attracts magnets, and the part of the recess cover plate that is supported on the bridge panel is held down on the metal sheet by magnetic strips affixed to the recess cover plate. The bridge panel cover plate is received on the portion of the bridge panel between the first end of the bridge panel and the end of the recess cover plate closer to floor A, the upper surfaces of the bridge panel cover plate and the recess cover plate normally being flush with each other. When the motion-absorbing gap closes in an earthquake, the magnetic strips release from the upper surface of the bridge panel, and the recess cover plate slides over the top of the bridge panel cover plate.

Among the advantages of the magnetic hold-down feature are the low sliding resistance of the magnets, which allows the recess cover plate to slide easily over the bridge panel when the gap widens, a desirably high hold-down force, low cost, and ease of installation. Moreover, the magnetic strips act as spacers between the recess cover plate and the bridge panel, thus avoiding metal to metal contact and reducing noise when persons and objects move across the cover plate. The magnitude of the hold-down force is readily established at a predetermined level by the total area of the magnetic strips. The bridge panel cover plate may also be held down on the bridge panel by magnetic strips affixed to the bridge panel cover plate, which provides the foregoing advantages and also permits the recess and panel cover plates to be of the same thickness and to be flush with each other.

A thermal expansion gap is provided between adjacent ends of the recess cover plate and bridge panel cover plate. The recess cover plate and bridge panel cover plate have nosings at the expansion gap configured to cause the recess cover plate to ride up over the upper surface of the bridge panel cover plate when the motion-absorbing gap closes in an earthquake. The nosings may include inter-engaging inclined surfaces that provide a camming action when they engage that lifts the end of recess cover plate at the expansion gap upwardly so that the bridge panel cover plate can slide under it. The nosing on the bridge panel cover plate has a top recess and the nosing on the recess cover plate has a tongue received in the top recess. The overlapping of the recess and tongue keeps the joint closed as the expansion gap narrows and widens due to thermal expansion and contraction.

To facilitate lifting of the recess cover plate, it is desirable to join the recess cover plate to the end frame member for resilient tilting movement. In an arrangement that is advantageous for its simplicity, minimal cost, and ease of installation, elastomeric washers are interposed between the recess cover plate and the end frame member.

For a better understanding of the invention, reference may be made to the following description of an exemplary embodiment, taken in conjunction with the accompanying drawings.

DESCRIPTION OF THE EMBODIMENT

The embodiment is configured for installation in a passageway between floor portions A and B on either side of a motion-absorbing gap G between two structural units of a building, the two units being designed so that they are able to displace and sway toward and away from each other perpendicular to the gap and from side to side parallel to the gap in an earthquake. Commonly, but not necessarily, the two building units will be supported by isolators; recently built additions in earthquake-prone regions are almost always supported on isolators while the existing structures often are not. The gap G is wide enough to prevent the units from ever making contact when they sway and may be from, say, 12 to 48 inches in width under normal (no earthquake) conditions. Accordingly, the expansion joint cover assembly will be designed to permit total relative horizontal displacements, both perpendicular to and parallel to the gap, in an earthquake of nearly twice those magnitudes. For example, a cover for a gap of 40 inches will be designed to allow the gap to narrow to near 0 inches and to widen to nearly 80 inches.

The relative movements of the building units are of necessity accompanied by a small amount of tilting of the floor portions at the perimeter, and the tilting results in relative vertical movements and skewing such that the floor portions do not remain level. A seismic expansion joint assembly, according to the present invention, absorbs the relative horizontal, vertical and skewing displacements resulting from swaying of the units in an earthquake.

Figure 1:
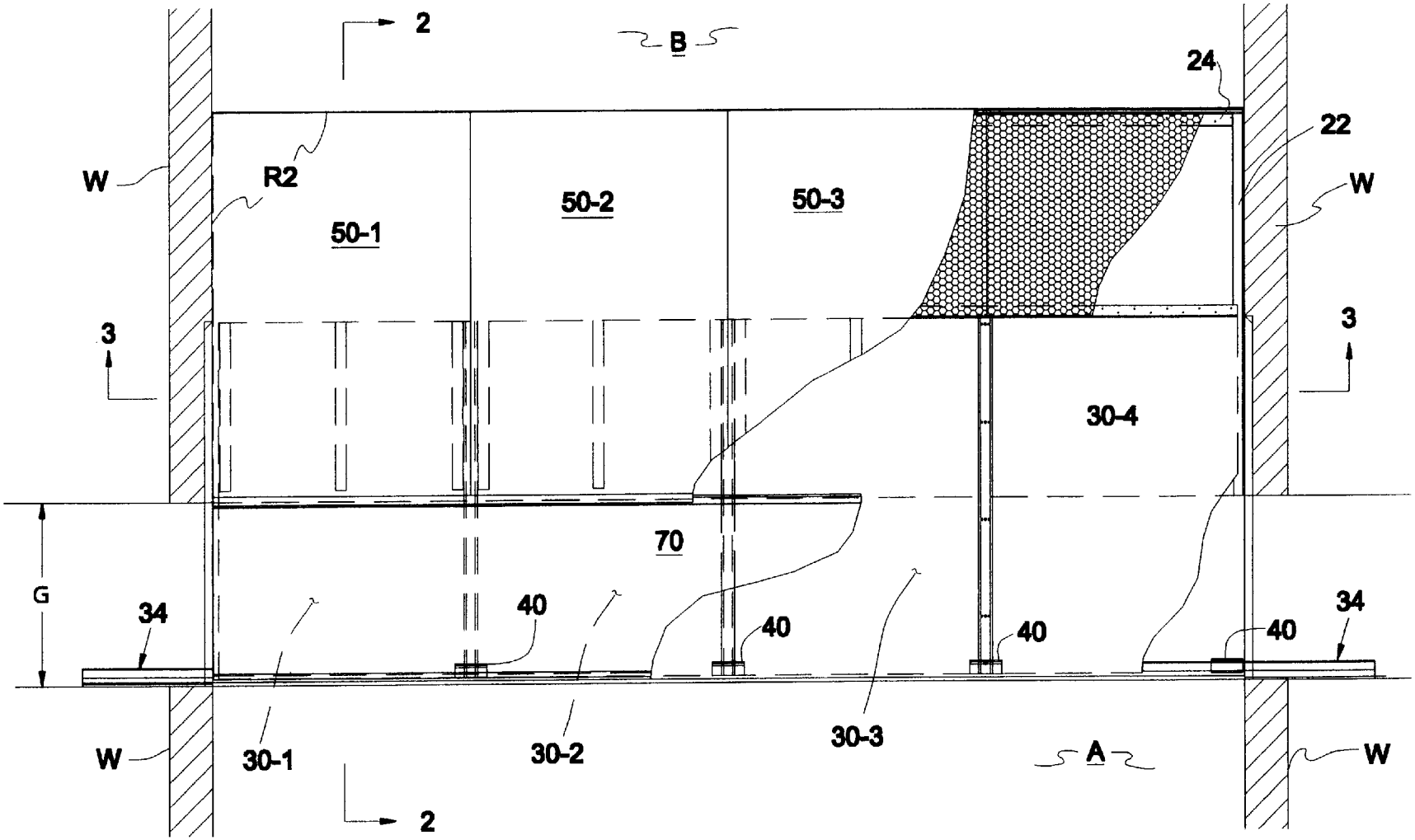
FIG. 1 is a schematic top plan view of the embodiment as installed in floors on opposite sides of a motion-absorbing gap and showing the normal or nominal condition of the expansion joint cover.
Figure 2:
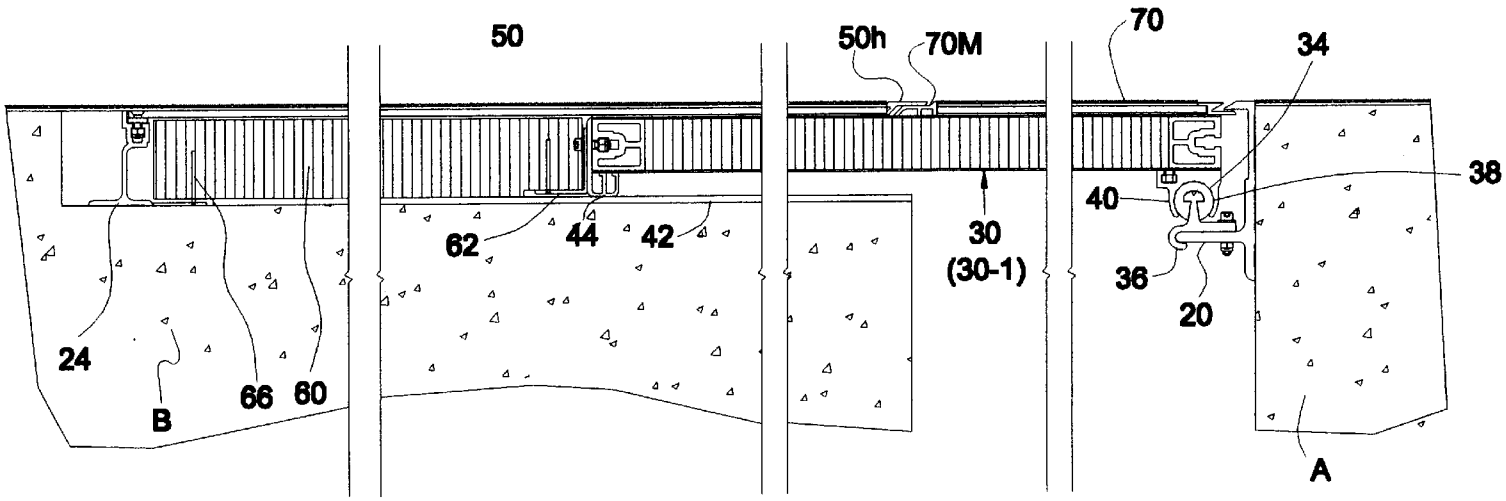
FIG. 2 is a simplified side cross-sectional view of the embodiment of FIG. 1 with portions broken away, the section being taken along the lines 2—2 of FIG. 1.

The floor portion A requires no preparation for reception of the illustrated embodiment of the seismic expansion joint cover other than a reasonably planar vertical edge for installation of an elongated retainer 20 (see FIGS. 1 and 2), which extends the full width of the passageway between the side walls W and a distance outwardly beyond the walls W to permit y-axis movements of the bridge panel (described below) relative to the floor A. Floor A may, alternatively, have a recess at the edge of the gap that receives a retainer. The floor B is prepared with a large rectangular recess R having a width (parallel to the gap), a length (perpendicular to the gap), and a depth sufficient to receive and to be bounded by a cover plate frame composed of pair of side members 22 (FIG. 3) and an end member 24 (FIG. 2).

Most of the metal members of the assembly are aluminum extrusions and are, thus, of uniform cross-sections along their lengths. For the most part, it will be apparent from the drawings and the following description that suitable holes are drilled or bolt-head grooves are formed in the components for receiving various fasteners. Where the metal members are joined to each other, the connections may be made at butt or bevel joints by welding or using angles and fasteners. The following description generally does not include references to holes, bolt-head grooves and other details, such as connections, that are readily seen in the drawings and/or are matters of ordinary design skill.

A major component of the assembly is a floor bridge panel 30, which spans the gap G in all positions of the floors A and B relative to each other. In many cases, and as shown, it is desirable to fabricate the floor bridge panel in two or more modular parts 30-1, 30-2, etc. that are small enough to be moved into the building and up to the floor where they are to be installed after the building is built and partly finished and joined together by splice channels 30*s* at the place of installation. Modular construction also facilitates manufacture and shipment. Each modular part is built up from a panel frame of frame members that are suitably connected where they meet. The spaces defined by the frame members receive sandwiches consisting of facing sheets and a honeycomb core bonded to the sheets. The edges of the facing sheets overlap the faces of the frames around them and are bonded adhesively where they overlap. For a reason that is explained below, at least the top sheet 32 of each modular part 30-1, etc. is made of a material that attracts permanent magnets, such as a galvanized steel sheet. The floor bridge panel 30 is strong and rigid and yet light in weight, the light weight being important to minimizing inertial forces that act throughout the seismic expansion joint cover system in an earthquake.

Figure 10:
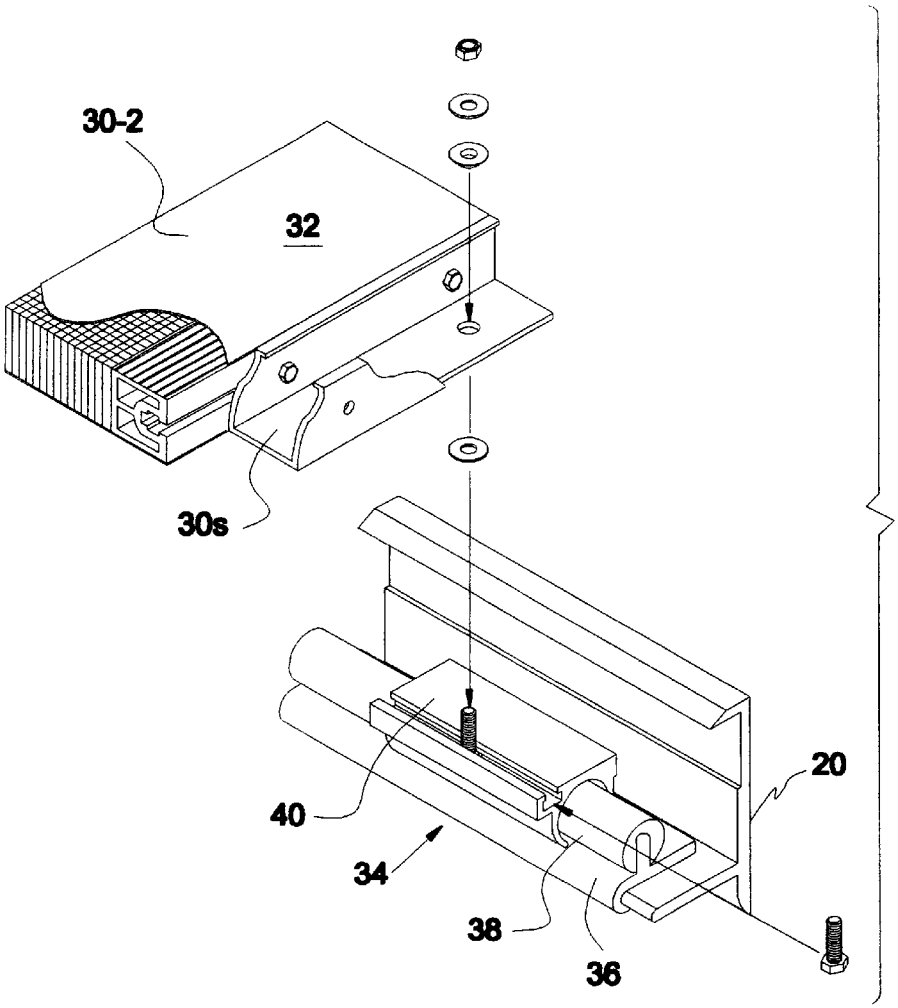
FIG. 10 is a detail exploded perspective view of a y-axis mounting assembly by which the bridge panel is supported on floor B.
Figure 11:
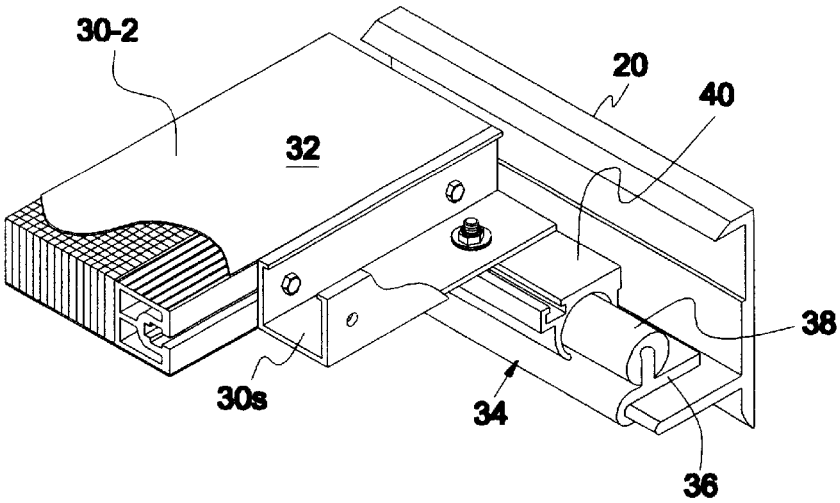
FIG. 11 is a detail perspective view of the mounting assembly shown in FIG. 10.

The floor A retainer 20 supports a bearing 34 (see FIGS. 2, 10 and 11) that includes a longitudinally continuous bearing holder 36 and a bearing member 38—also longitudinally continuous—of a high density low friction polymeric material, such as polypropylene. Bearing blocks 40 a few inches in length are fastened to the splice channels 30s at the floor A end of the bridge panel 30 and slide along the bearing member 38. Each bearing block 40 is fastened to the splice channel 30s by a single bolt/washer/nut set 41 so as to permit the bearing block to pivot in case there are irregularities in the bearing member 38. In an earthquake, the bearing support of the floor A end of the bridge panel 30 on the bearing member 38 by the bearing blocks 40 permits floor A to move in the y-axis direction relative to the bridge panel—note the extensions of the bearings 34 laterally outwardly beyond the sides of the bridge panel in FIG. 1.

Figure 3:
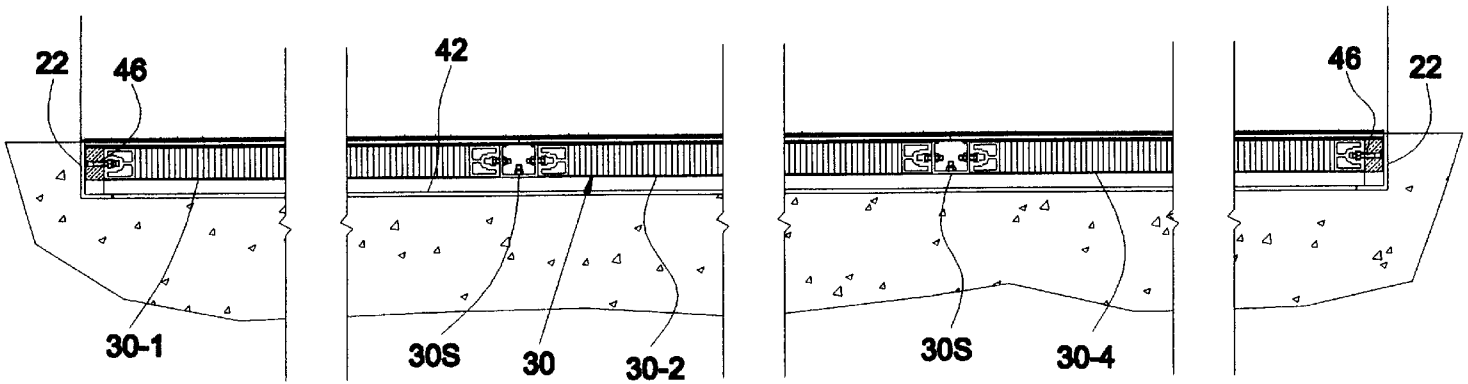
FIG. 3 is a simplified side elevational view of the embodiment of FIG. 1 with portions broken away, the section being taken along the lines 3—3 of FIG. 1.

The base or floor of the recess R in floor B is lined with a liner sheet 42 of a low friction material, such as a high-density polypropylene. A B-end support foot 44 attached to the floor B end of the bridge panel rests on the liner sheet and supports the floor B end of the bridge panel on floor B. The floor B end portion of the bridge panel is also guided along each side frame 22 of the recess R by side guide blocks 46 of a low friction material (e.g., polypropylene) that are fastened to the bridge panel (FIG. 3). In an earthquake, the floor bridge panel 30 is retained in the recess R in floor B against lateral (y-axis) movement relative to floor B but moves in the x-axis direction relative to floor B. The x-axis movements of the bridge panel relative to floor B result in large variations in the size of the part of the recess R that is not occupied by a portion of the bridge panel, as may be seen by comparing FIGS. 4 to 6. The bridge panel can also lift up (Z-axis) and tilt (about the X-axis) relative to floor B.

The part of the recess R in floor B that is not occupied by the floor B end portion of the bridge panel 30 is covered by a recess cover plate 50. Like the bridge panel 30, it is advantageous to make the recess cover plate in modular parts 50-1, 50-2, etc. The end of each part the recess cover plate 50 remote from the gap G is attached to the end frame member 24 of the recess frame by screws 52. Elastomeric washers 54 (FIG. 7) inserted between the top flange of the frame member 24 and the recess cover plate prevent metal to metal contact and allow the recess cover plate to pivot slightly about an axis defined by the row of screws 52 by elastic deformation of the washers 54.

To avoid having to make the recess cover plate thick and heavy—heavy means high inertial forces and increased costs—and to avoid the complications in the construction of the bridge panel 30 that would be required to have reinforcing ribs or the like on the recess cover plate, the otherwise open space within the part of the recess R that is not occupied by the floor bridge panel is filled by a honeycomb panel 60 (see FIGS. 4 to 6), which supports the portion of the recess cover plate that spans the recess between the floor B end of the bridge panel 30 and the end frame member 24 of the recess frame. One end of the honeycomb panel 60 is coupled to the bridge panel 30 by a first coupling member 62 that is fastened to the bridge panel and has many spaced-apart upstanding pins 64, each pin being received in a cell of the honeycomb panel. The other end is secured against horizontal movements in any direction relative to the end frame member 24 by a second coupling member 66, likewise having many spaced-apart upstanding pins 68, each of which is received in a cell of the honeycomb panel. The coupling member 66 merely drops into place between the end frame member 24 and the recess liner sheet 42 (see FIG. 4). The honeycomb panel is made of a deformable material, such as paperboard impregnated with a polymeric material. Such panels are available commercially from Unicel Corp.

Figure 4:
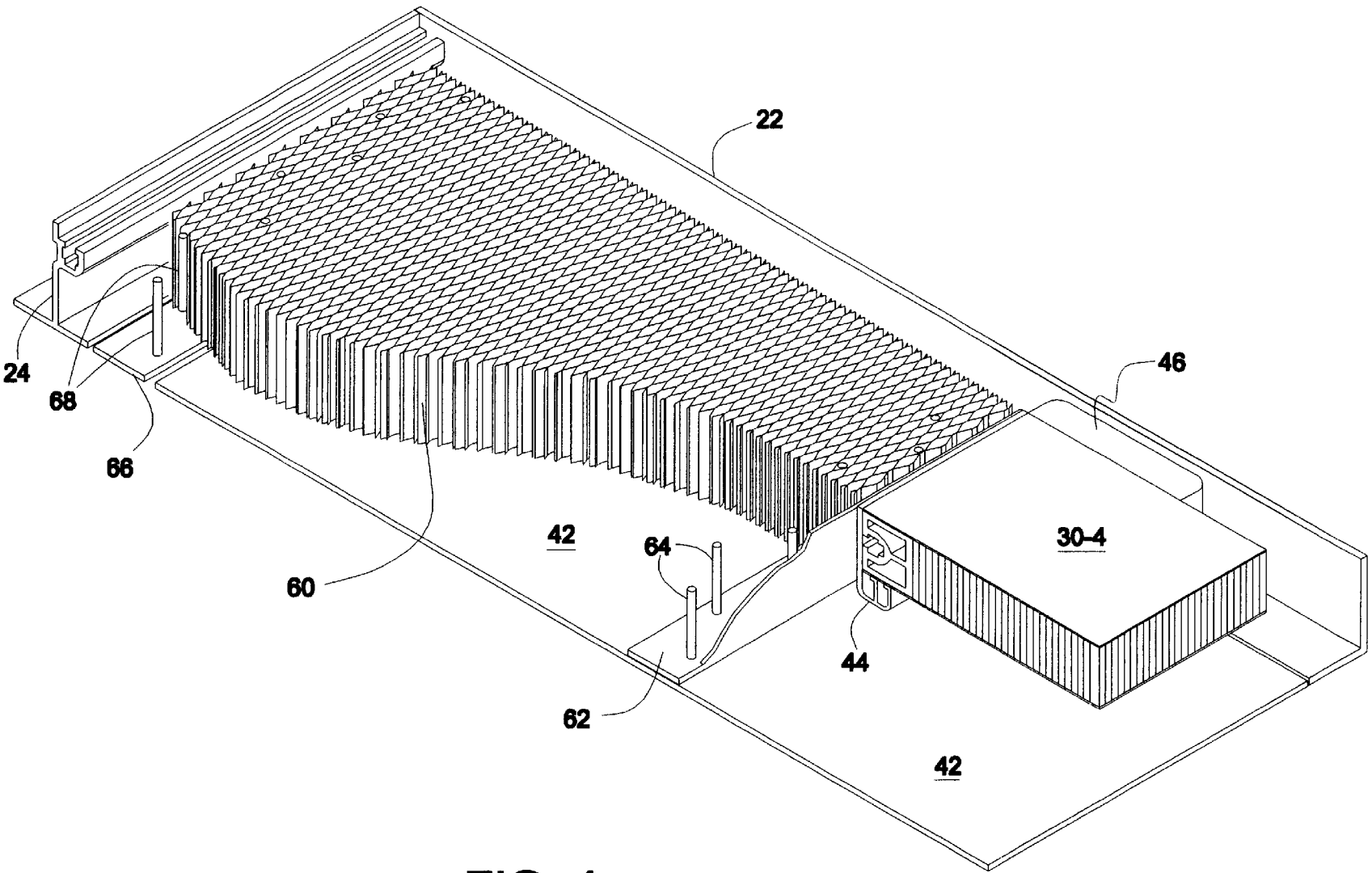
FIG. 4 is a simplified perspective view of a portion of the embodiment, showing the recess cover plate removed and the condition when the motion-absorbing gap is at its normal width.
Figure 5:
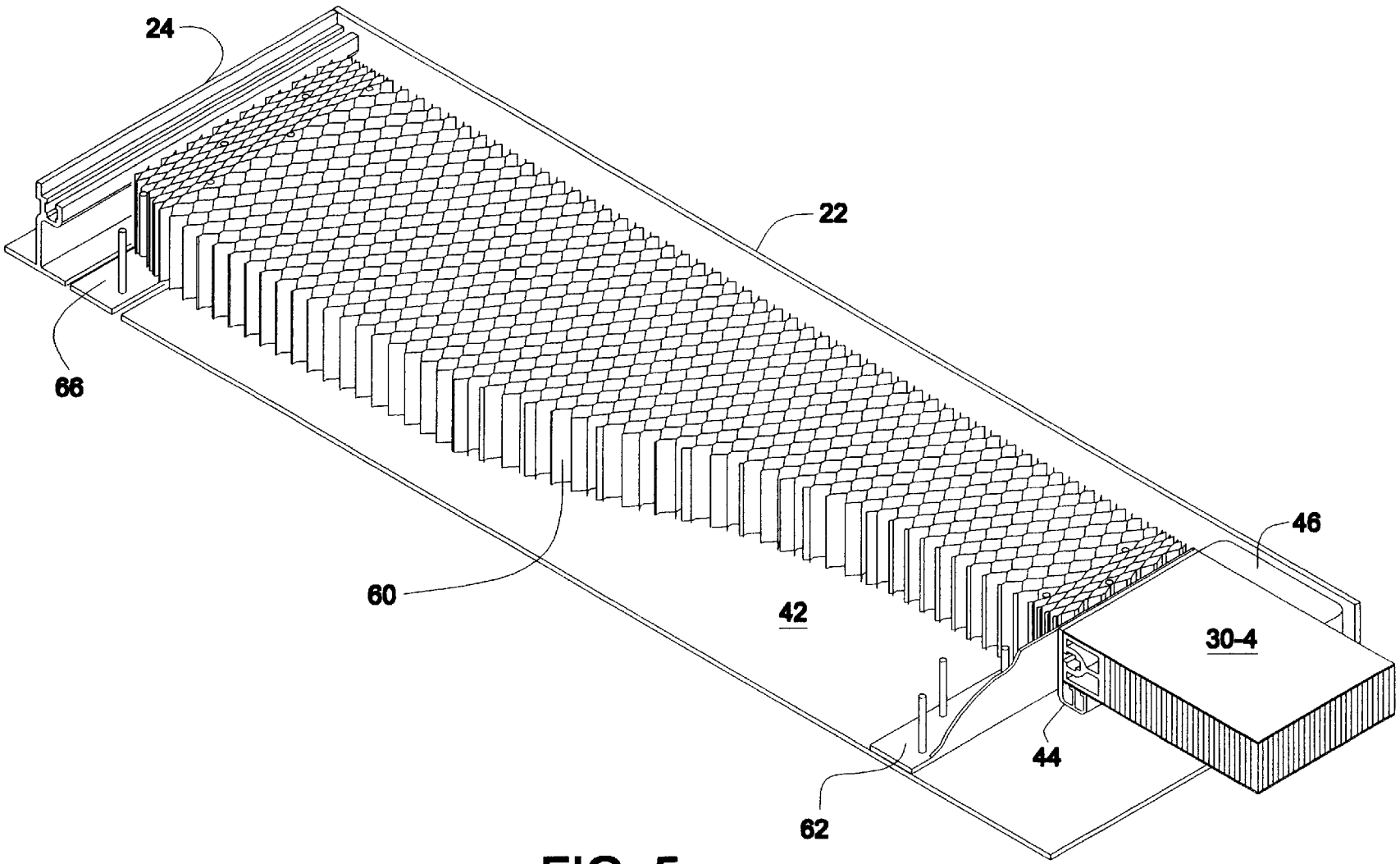
FIG. 5 is a view similar to FIG. 4 but shows the gap at maximum expansion.
Figure 6:
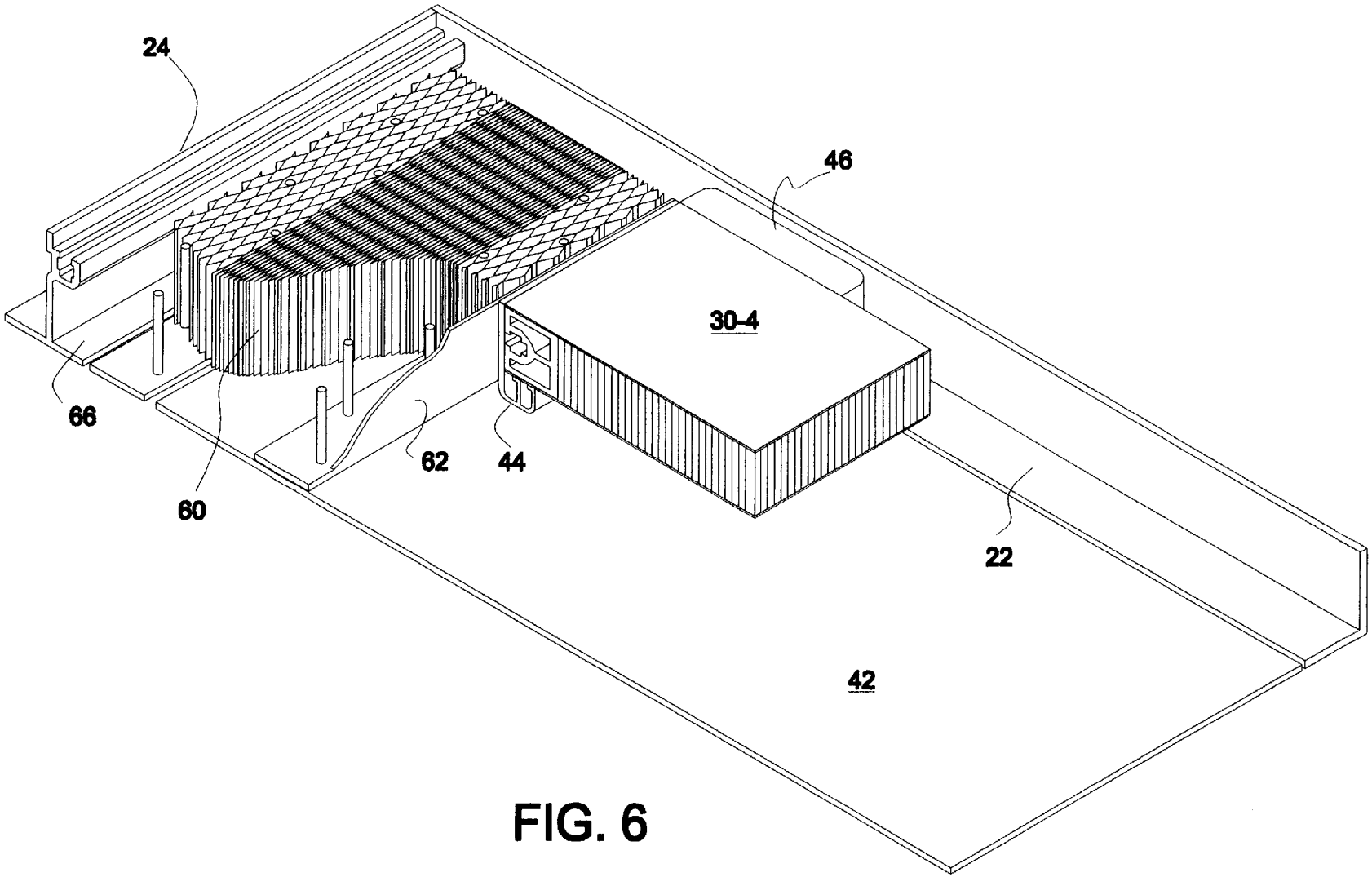
FIG. 6 is a view similar to FIG. 4 but shows the gap at maximum contraction.

As illustrated in FIGS. 4 to 6, when the bridge panel moves away from the end frame member 24 upon a widening of the motion-absorbing gap G in an earthquake, the honeycomb panel extends (FIG. 5) from the normal state (FIG. 4); upon narrowing of the gap G and movement of the bridge panel toward the end frame member 24, the honeycomb panel is compressed (FIG. 6). In all positions of the bridge panel relative to floor B, the honeycomb panel 60 fills the volume of the recess under the portion of the recess cover plate 50 between the end frame member 24 and the floor B end of the bridge panel and supports loads on the recess cover plate.

The x-axis dimension of the recess cover plate is such that a portion at the end closer to the gap G is always supported on a portion of the bridge panel adjacent the floor B end. In the normal state (no earthquake), the recess cover plate overlaps about one-half of the x-axis dimension of the bridge panel (see FIG. 1). The portion of the bridge panel between the floor A end of the recess cover plate and the floor A end of the bridge panel is covered by a panel cover plate 70. The adjacent ends of the recess cover plate and panel cover plate have nosings 50*n* and 70*n* (see FIG. 9A, 9B, and 9C) that overlap, a tongue 50*nt* overlying a recess 70*nr* in sliding relation. In the normal or nominal positions of the recess cover plate and panel cover plate (FIG. 9A), a small gap exists, which allows for relative movements of the recess cover plate and panel cover plate such as those due to thermal expansion and contraction of the structures.

Figure 7:
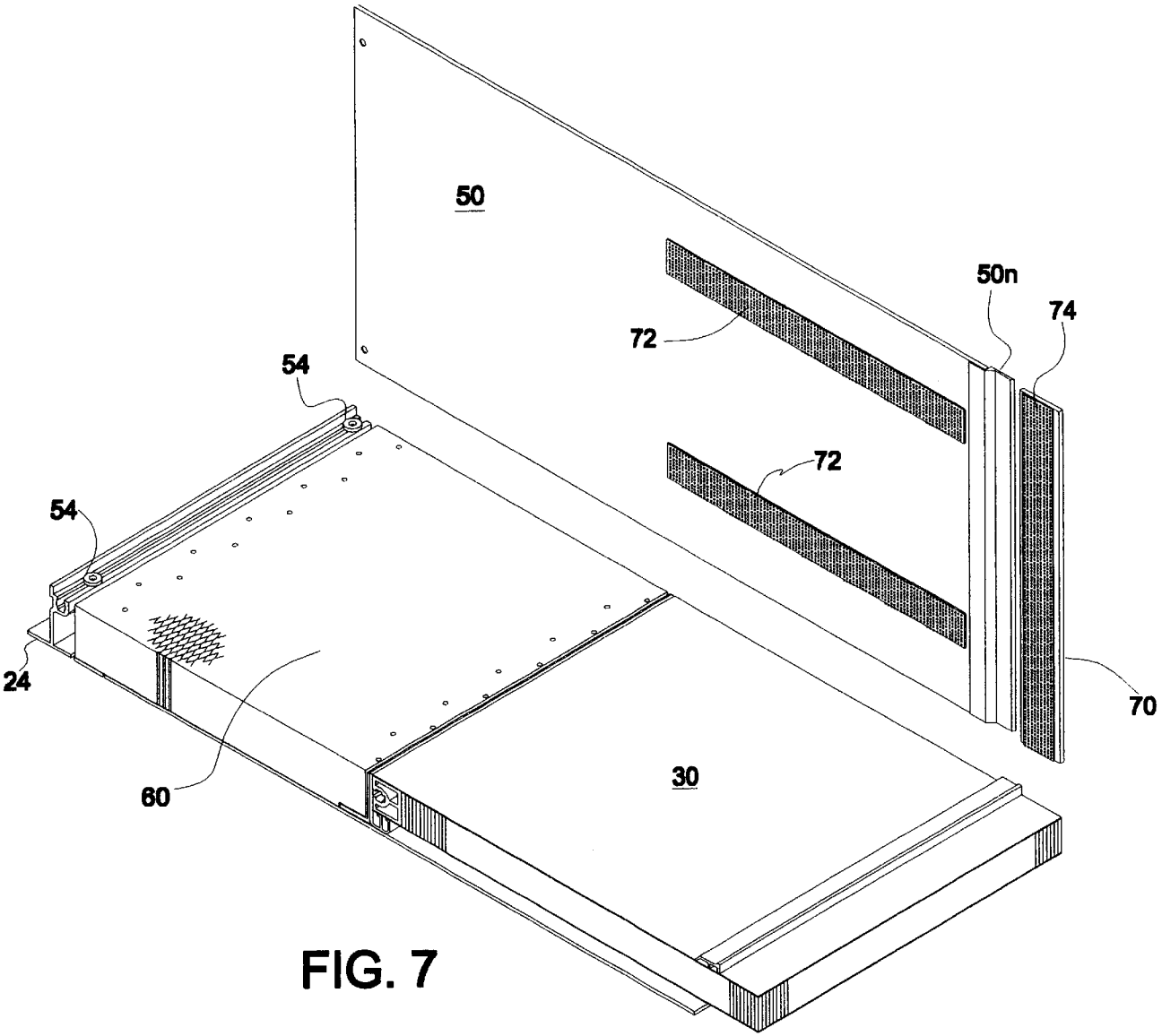
FIG. 7 is a simplified exploded perspective view of a portion of the embodiment, showing the recess cover plate lifted up.
Figure 8:
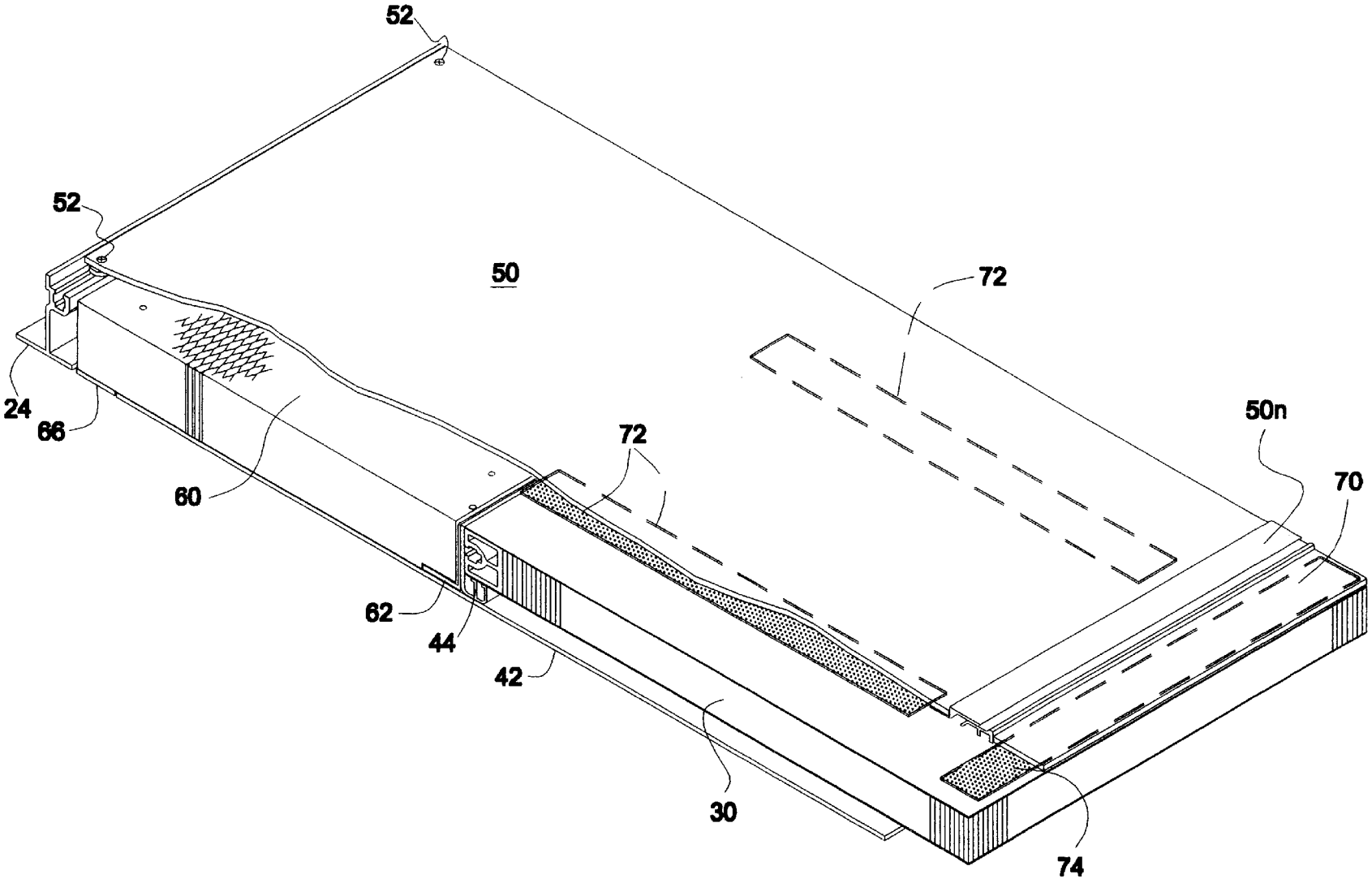
FIG. 8 is a view similar to FIG. 7 but shows the recess cover plate installed.

Referring to FIGS. 7 and 8, strips 72 of permanent magnetic material (strips of material like refrigerator magnets) bonded to the underside of the recess cover plate hold the recess cover plate down in engagement with the upper surface of the bridge panel—recall that the top face sheet of the bridge panel is of a magnetically attractive material. Strips 74 of permanent magnetic material are also used to secure the panel cover plate in place on the bridge panel. The magnetic strips have the advantages of making it easy to install and remove the recess cover plate and panel cover plate, maintaining the upper surfaces of the recess cover plate and panel cover plate flush with each other, and avoiding metal to metal contact. The total area of the strips, as a matter of design, determines the hold-down force.

Figure 9B:
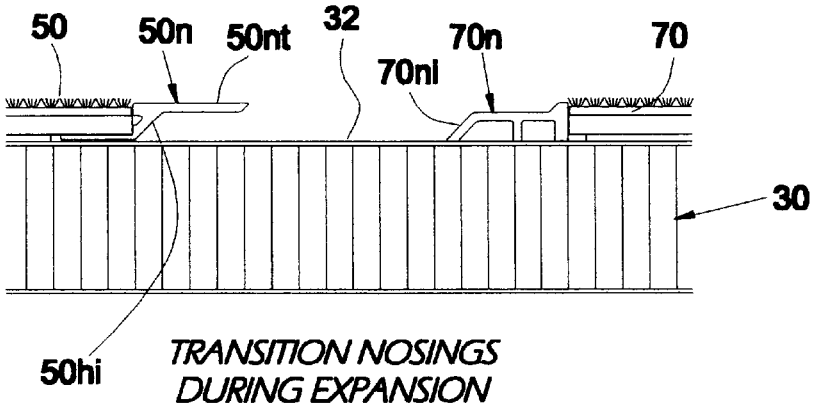
FIGS. 9A, 9B and 9C are detail cross-sectional views of the expansion gap between the recess cover plate and the bridge panel cover plate and show it at the normal, partly extended, and partly contracted positions, respectively.
Figure 9A:
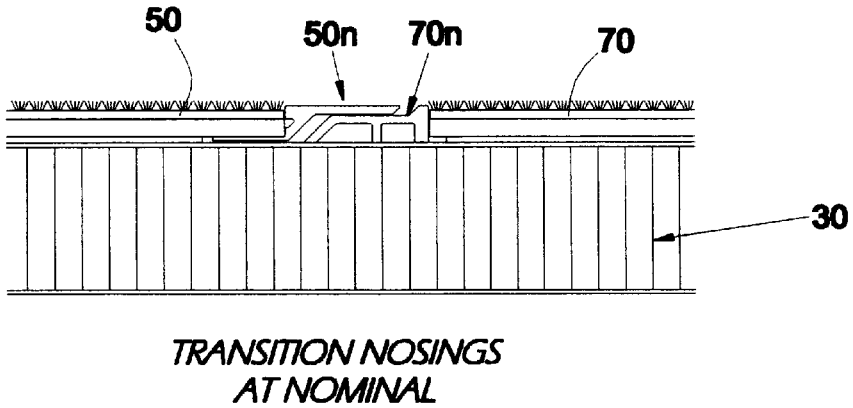
Figure 9C:
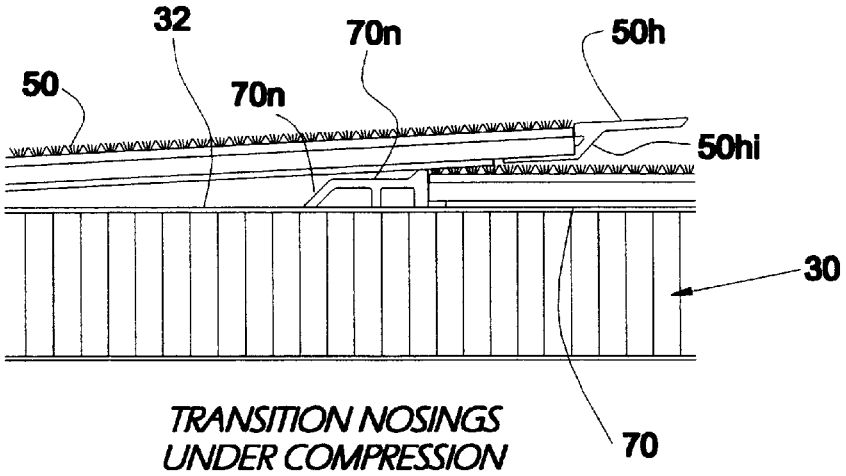

In an earthquake, movements of the floors A and B that result in widening of the gap cause endwise separation of the recess cover plate from the panel cover plate (FIG. 9B). Sliding movement of the bridge panel under the recess cover plate is readily permitted by the magnetic strips, which offer little resistance to sliding. When the gap G narrows, the nosings at the adjacent ends of the recess cover plate and panel cover plate engage (see FIG. 9A), whereupon, mating inclined surfaces 50*ni* and 70*ni* apply a camming action to the end of the recess cover plate 50, which lifts up the floor A end so that the panel cover plate can slide under the recess cover plate (FIG. 9C). Of course, the magnetic strips release the recess cover plate so that it can be lifted up and ride over the top of the panel cover plate. The elastomeric washers 54 associated with the fastening of the recess cover plate to the end frame 24 facilitate the lifting up of the recess cover plate.

What is claimed is:

1. A seismic expansion joint cover assembly that is adapted to span a motion-absorbing gap between a floor A on one side of the gap and a floor B on the other side of the gap and that permits relative movements of floors A and B substantially horizontally toward and away from each other along an x-axis perpendicular to the gap and relative movements of floors A and B substantially horizontally relative to each other along a y-axis parallel to the gap, comprising a bridge panel, a retainer adapted to be affixed to floor A and supporting a first end of the bridge panel for movement along in the y-axis direction and against movement in the x-axis direction relative to floor A, a recess frame adapted to be affixed in a recess in floor B that receives portions of the bridge panel in all positions of the bridge panel relative to floor B, a recess cover plate adapted to cover the recess, having a first end supported in sliding relation on the bridge panel in all positions of the bridge panel relative to floor B, and a second end joined to an end member of the recess frame remote from the motion-absorbing gap, and a collapsible/extensible honeycomb panel adapted to be received in the recess in floor B and supporting the portion of the recess cover plate that spans the recess between the second end of the bridge panel and the end member of the recess frame.

2. The seismic expansion joint cover assembly according to claim 1 wherein a first end of the honeycomb panel is coupled to the bridge panel and a second end is secured against horizontal movements relative to the end member of the recess frame.

3. The seismic expansion joint cover assembly according to claim 2 wherein the honeycomb panel is coupled to the bridge panel by a first coupling member having many spaced-apart upstanding pins, each pin being received in a cell of the honeycomb panel.

4. The seismic expansion joint cover assembly according to claim 2 wherein the honeycomb panel is secured against movement relative to the end member of the recess frame by a second coupling member having many spaced-apart upstanding pins, each pin being received in a cell of the honeycomb panel.

5. The seismic expansion joint cover assembly according to claim 2 wherein the underside of the honeycomb panel is supported in sliding relation on a sheet of low-friction polymeric material.

6. The seismic expansion joint cover assembly according to claim 2 wherein the honeycomb panel is of a material selected from paper impregnated with a resin, aluminum and stainless steel.

7. The seismic expansion joint cover assembly according to claim 1 wherein the bridge panel includes an upper surface formed by-a sheet of a magnet-attracting material and the part of the recess cover plate that is supported on the bridge panel is held down on the sheet by magnetic strips affixed to the recess cover plate.

8. The seismic expansion joint cover assembly according to claim 7 and further comprising a bridge panel cover plate received on the portion of the bridge panel between the first end of the bridge panel and the end of the recess cover plate closer to floor A, the upper surfaces of the bridge panel cover plate and the recess cover plate normally being flush with each other.

9. The seismic expansion joint cover assembly according to claim 8 wherein the bridge panel cover plate is held down on the bridge panel by magnetic strips affixed to the bridge panel cover plate.

10. The seismic expansion joint cover assembly according to claim 8 wherein a thermal expansion gap is provided between adjacent ends of the recess cover plate and bridge panel cover plate.

11. The seismic expansion joint cover assembly according to claim 10 wherein the recess cover plate and bridge panel cover plate have nosings at the expansion gap configured to cause the recess cover plate to ride up over the upper surface of the bridge panel cover plate when the motion-absorbing gap closes in an earthquake.

12. The seismic expansion joint cover assembly according to claim 11 wherein the nosings including inter-engaging inclined surfaces.

13. The seismic expansion joint cover assembly according to claim 11 wherein the nosing on the bridge panel cover plate has a top recess and the nosing on the recess cover plate has a tongue received in the top recess.

14. The seismic expansion joint cover assembly according to claim 11 wherein the recess cover plate is joined to the end frame member for resilient tilting movement.

15. The seismic expansion joint cover assembly according to claim 14 wherein elastomeric washers interposed between the recess cover plate and the end frame member enable the resilient tilting movement.

16. A seismic expansion joint cover assembly that is adapted to span a motion-absorbing gap between a floor A on one side of the gap and a floor B on the other side of the gap and that permits relative movements of floors A and B substantially horizontally toward and away from each other along an x-axis perpendicular to the gap and relative movements of floors A and B substantially horizontally relative to each other along a y-axis parallel to the gap, comprising a bridge panel having an upper surface formed by a sheet of a ferrous metal, a retainer adapted to be affixed to floor A and supporting a first end of the bridge panel for movement in the y-axis direction and against movement in the x-axis direction relative to floor A, a recess frame adapted to be affixed in a recess in floor B that receives portions of the bridge panel in all positions of the bridge panel relative to floor B, a recess cover plate adapted to cover the recess and having a first end supported in sliding relation on the bridge panel in all positions of the bridge panel relative to floor B and a second end joined to an end member of the recess frame remote from the motion-absorbing gap, and magnetic strips affixed to the underside of the recess cover plate holding the part of the recess cover plate that is supported on the bridge panel down on the ferrous metal sheet.

17. The seismic expansion joint cover assembly according to claim 16 and further comprising a bridge panel cover plate received on the portion of the bridge panel between the first end of the bridge panel and the end of the recess cover plate closer to floor A, the upper surfaces of the bridge panel cover plate and the recess cover plate normally being flush with each other.

18. The seismic expansion joint cover assembly according to claim 17 wherein the bridge panel cover plate is held down on the bridge panel by magnetic strips affixed to the bridge panel cover plate.

19. The seismic expansion joint cover assembly according to claim 17 wherein a thermal expansion gap is provided between adjacent ends of the recess cover plate and bridge panel cover plate.

20. The seismic expansion joint cover assembly according to claim 17 wherein the recess cover plate and bridge panel cover plate have nosings at the expansion gap configured to cause the recess cover plate to ride up over the upper surface of the bridge panel cover plate when the motion-absorbing gap closes in an earthquake.

21. The seismic expansion joint cover assembly according to claim 20 wherein the nosings including inter-engaging inclined surfaces, the nosing on the bridge panel cover plate has a top recess, and the nosing on the recess cover plate has a tongue received in the top recess.

22. The seismic expansion joint cover assembly according to claim 17 wherein the recess cover plate is joined to the end frame member for resilient tilting movement.

23. The seismic expansion joint cover assembly according to claim 22 wherein elastomeric washers interposed between the recess cover plate and the end frame member enable the resilient tilting movement.

* * * * *